US008205828B2

(12) United States Patent
Bossert et al.

(10) Patent No.: US 8,205,828 B2
(45) Date of Patent: Jun. 26, 2012

(54) SUBMERSIBLE TRANSPORT AND LAUNCH CANISTER

(75) Inventors: David E. Bossert, Tucson, AZ (US); Jeffrey N. Zerbe, Oro Valley, AZ (US); Ray Sampson, Dartmouth, CA (US)

(73) Assignee: Raytheon Company, Waltham, MA (US)

( * ) Notice: Subject to any disclaimer, the term of this patent is extended or adjusted under 35 U.S.C. 154(b) by 346 days.

(21) Appl. No.: 12/716,731

(22) Filed: Mar. 3, 2010

(65) Prior Publication Data

US 2012/0068009 A1 Mar. 22, 2012

(51) Int. Cl.
*B64F 1/04* (2006.01)

(52) U.S. Cl. ..... 244/63; 114/316; 114/238; 89/1.81

(58) Field of Classification Search ..... 244/63; 89/1.81

See application file for complete search history.

(56) References Cited

U.S. PATENT DOCUMENTS

| | | | | |
|---|---|---|---|---|
| 3,158,062 | A | 11/1964 | Feiler | |
| 3,279,319 | A | 10/1966 | Semonian et al. | |
| 3,499,364 | A | 3/1970 | D'Ooge | |
| 3,716,009 | A | 2/1973 | Strickland | |
| 4,033,225 | A | 7/1977 | Kartzmark, Jr. | |
| 4,566,367 | A | 1/1986 | Hickey | |
| 5,170,005 | A * | 12/1992 | Mabry et al. | 89/1.81 |
| 5,520,486 | A | 5/1996 | Van Wyck | |
| 5,615,847 | A | 4/1997 | Bourlett | |
| 5,646,366 | A * | 7/1997 | O'Connell | 114/21.2 |
| 5,666,900 | A * | 9/1997 | Carroll et al. | 114/316 |
| 5,695,153 | A * | 12/1997 | Britton et al. | 244/63 |
| 6,056,237 | A * | 5/2000 | Woodland | 244/3.15 |
| 6,164,179 | A * | 12/2000 | Buffman | 89/1.81 |
| 6,286,410 | B1 * | 9/2001 | Leibolt | 89/1.809 |
| 7,410,124 | B2 * | 8/2008 | Miller et al. | 244/63 |
| 7,448,339 | B2 * | 11/2008 | Bruengger et al. | 114/244 |
| 7,472,866 | B2 * | 1/2009 | Heaston et al. | 244/63 |
| 7,540,796 | B2 | 6/2009 | Spears et al. | |
| 2002/0170419 | A1 | 11/2002 | Borgwarth et al. | |
| 2008/0111021 | A1 | 5/2008 | Toth et al. | |
| 2009/0107386 | A1 | 4/2009 | Sampson et al. | |

FOREIGN PATENT DOCUMENTS

DE 2032126 A1 1/1972

(Continued)

OTHER PUBLICATIONS

USPTO "Non-Final Office Action" mailed Apr. 13, 2011; U.S. Appl. No. 12/233,254, filed Sep. 18, 2008.

(Continued)

*Primary Examiner* — Michael Carone
*Assistant Examiner* — Medhat Badawi
(74) *Attorney, Agent, or Firm* — Renner, Otto, Boisselle & Sklar, LLP

(57) ABSTRACT

Embodiments of a submersible transport and launch canister are provided for use by a diver in the deployment of an airborne object. In one embodiment, the submersible transport and launch canister includes a pressure vessel having an open end portion and a storage cavity configured to receive the airborne object therein. A diver-actuated cap is movable between an open position and a closed position in which the diver-actuated cap sealingly engages the open end portion. A propellant device is fluidly coupled to the storage cavity and is configured to propel the airborne object from the storage cavity and through the open end portion when the propellant device is actuated by the diver.

19 Claims, 6 Drawing Sheets

FOREIGN PATENT DOCUMENTS

| | | | |
|---|---|---|---|
| GB | 2280251 | A | 1/1995 |
| WO | 9639325 | | 12/1996 |
| WO | 2008054336 | A2 | 5/2008 |

OTHER PUBLICATIONS

USPTO Final Office Action mailed Nov. 18, 2010; U.S. Appl. No. 12/233,328, filed Sep. 18, 2008.
Australian Government "Examnier's First Report" mailed Oct. 18, 2011; Australian Patent Appln. No. 2009293068.
USPTO Final Office Action mailed May 4, 2010; U.S. Appl. No. 12/233,328, filed Sep. 18, 2008.
Raytheon Company, International Search Report for PCT Application No. PCT/US2011/032698, dated Aug. 3, 2011.
Raytheon Company, International Search Report for PCT Application No. PCT/US2011/032700, dated Aug. 3, 2011.
International Searching Authority, European Patent Office, "International Search Report," mailed May 27, 2008; International Application No. PCT/US2008/076769, filed Sep. 18, 2008.
International Searching Authority, European Patent Office, "International Search Report," mailed Dec. 4, 2009; International application No. PCT/US2009/057525, filed Sep. 18, 2009.
Bossert, David E. et al. "Methods and Apparatus for Marine Deployment," U.S. Appl. No. 12/233,254, filed Sep. 18, 2008.
Sampson, Ray et al. "Methods and Apparatus for Marine Deployment," U.S. Appl. No. 12/233,328, filed Sep. 18, 2008.
USPTO Non-Final Office Action mailed Jul. 13, 2010; U.S. Appl. No. 12/233,328, filed Sep. 18, 2008.
Bossert, David E. et al. "Remotely-Triggered Submerged Launch Canisters," U.S. Appl. No. 12/848,449, filed Aug. 2, 2010.
Bossert, David E. et al. "Remotely-Triggered Submerged Launch Canisters and Methods Relating to the Usage and Preparation Thereof," U.S. Appl. No. 12/848,455, filed Aug. 2, 2010.
European Patent Office, International Searching Authority, "International Search Report" mailed Dec. 1, 2011; International Appln. No. PCT/US2011/026840, filed Mar. 2, 2011.
European Patent Office, International Searching Authority, "International Search Report" mailed Dec. 1, 2011; International Appln. No. PCT/US2011/026838, filed Mar. 2, 2011.
USPTO Non-Final Office Action mailed Dec. 2, 2009; U.S. Appl. No. 12/233,328, filed Sep. 28, 2008.
Bossert, David E. et al. "Submersible Transport and Launch Canister and Methods for the Use Thereof," U.S. Appl. No. 12/716,735, filed Mar. 3, 2010.
Bossert, David E. et al. "Submersible Transport Canister and Methods for the Use Thereof," U.S. Appl. No. 12/723,294, filed Mar. 12, 2010.

* cited by examiner

SUBMERSIBLE TRANSPORT AND LAUNCH CANISTER

TECHNICAL FIELD

The following disclosure relates generally to sea-to-air deployment systems and, more particularly, to embodiments of a submersible transport and launch canister for diver-initiated deployment of an airborne object, such as a Unmanned Aerial Vehicle.

BACKGROUND

In military and certain civilian contexts, Unmanned Aircraft Systems have become an increasingly important tool for gathering aerial intelligence, surveillance, and reconnaissance over designated geographical area. In overseas military operations, in particular, the ability to conduct covert aerial surveillance of a geographical area has become increasingly useful for monitoring the movement of enemy combatants and for identifying potential threats, such as improvised explosive devices. A given Unmanned Aircraft System often includes multiple Unmanned Aerial Vehicles ("UAVs"), various data links, and one or more ground control stations. The ground control stations are staffed by military personnel, which monitor streaming video feeds and other data supplied by the UAVs and which remotely pilot UAVs that are not fully autonomous.

With the increased usage of Unmanned Aircraft Systems, a demand has arisen for means by which smaller UAVs can be manually transported and launched on an as-needed basis by military personnel deployed in the field. To help satisfy this demand, tube-launched UAVs have recently been introduced that can be physically carried by ground troops and launched from ground-based ad hoc launch sites. More recently, the aerial deployment of tube-launched UAVs has been proposed from larger, manned aircraft. However, a need still exists for a means by which the sea-to-air deployment of tube-launched or other UAVs can be initiated by a submerged diver to provide, for example, covert littoral surveillance of a designated geographical area in support of a nearby on-the-ground troop presence.

It is thus desirable to provide embodiments of a submersible sea-to-air launch platform (referred to herein as a "submersible transport and launch canister") that can be utilized by a diver to transport and manually-initiate deployment of an airborne object, such as an Unmanned Aerial Vehicle. Ideally, embodiments of such a submersible transport and launch canister would be reliable, cost-effective, scalable, handsafe, and capable of preventing wetting of the Unmanned Aerial Vehicle during underwater transport and launch. It would also be desirable for embodiments of such a submersible transport and launch canister to enable the launch process to be performed in a covert manner by a submerged diver operating under adverse maritime conditions (e.g., low ambient light, Sea States approaching or exceeding Code 3, etc.). It would further be desirable for embodiments of such a submersible transport and launch canister to include means for ensuring that the launch process is performed at a predetermined launch angle to promote successful transition of the UAV to flight. Other desirable features and characteristics of the present invention will become apparent from the subsequent Detailed Description and the appended Claims, taken in conjunction with the accompanying Drawings and this Background.

BRIEF SUMMARY

Embodiments of a submersible transport and launch canister are provided for use by a diver in the deployment of an airborne object. In one embodiment, the submersible transport and launch canister includes a pressure vessel having an open end portion and a storage cavity configured to receive the airborne object therein. A diver-actuated cap is movable between an open position and a closed position in which the diver-actuated cap sealingly engages the open end portion. A propellant device is fluidly coupled to the storage cavity and is configured to propel the airborne object from the storage cavity and through the open end portion when the propellant device is actuated by the diver.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description. As appearing herein, the term "diver" is utilized in a broad sense to encompass any person working within a body of water, whether or not such a person is fully submerged and regardless of the particular manner in which such a person is equipped. Similarly, the term "canister" as appearing herein is defined broadly to include any sealable container, regardless of shape, size, structural features, material composition, etc., suitable for the underwater transport and launch of an Unmanned Aerial Vehicle or other airborne object as described more fully below.

Figure 1:
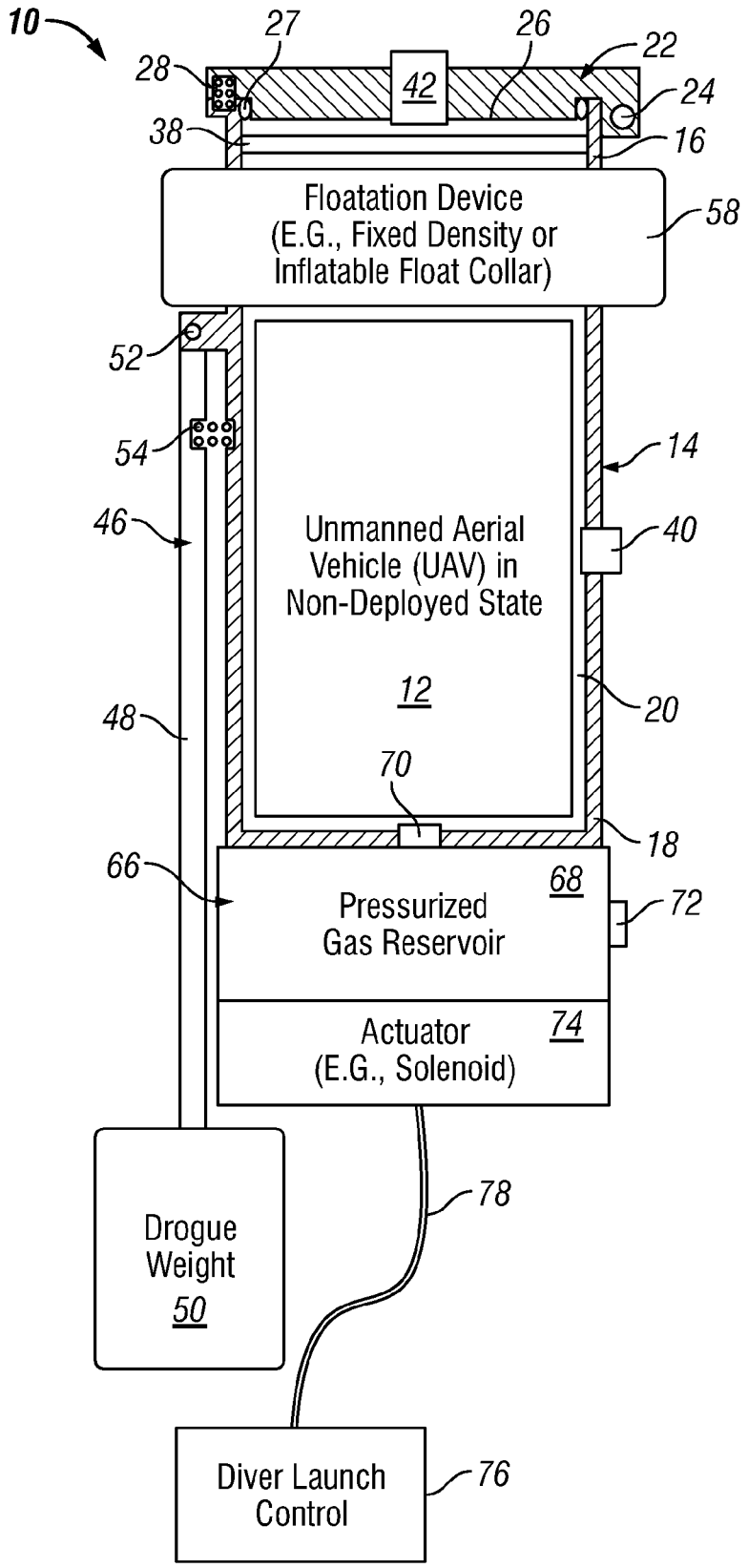
FIG. 1 is a functional block diagram of a Submersible Transport and Launch (STAL) canister in a watertight transport state and illustrated in accordance with an exemplary embodiment of the present invention.

FIG. 1 is a functional block diagram of a Submersible Transport and Launch (STAL) canister 10 in a watertight transport state and illustrated in accordance with an exemplary embodiment of the present invention. As will be described more fully below, STAL canister 10 enables a diver to manually transport and carry out the sea-to-air deployment of an airborne object (or objects) stored within canister 10 in adverse maritime conditions while the diver remains fully or partially submerged. STAL canister 10 is especially well-suited for the transport and diver-initiated launch of an Unmanned Aerial Vehicle included within an Unmanned Aircraft System of the type described above. For this reason, STAL canister 10 is illustrated in FIG. 1 and described herein below in conjunction with a generalized Unmanned Aerial Vehicle (UAV) 12. It is, however, emphasized that embodiments of STAL canister 10 can be utilized to transport and launch various other types of airborne objects including, but not limited to, airborne sensor packages, airborne munitions, airborne sub-munitions, communications relays and signal emitter, jammers, and the like.

With reference to the exemplary embodiment illustrated in FIG. 1, STAL canister 10 includes a pressure vessel 14 having an upper open end portion 16, a lower closed end portion 18, and a main storage cavity 20. As noted above, UAV 12 is stored within main storage cavity 20 in a non-deployed state. UAV 12 will typically include at least two collapsible wings, which are pivotally coupled to the body of UAV 12 and deploy (e.g., rotate outward from the body of UAV 12) during flight. The collapsible wings may be biased toward the deployed position by, for example, one or more springs. When UAV 12 is stowed within storage cavity 20, the collapsible wings may be maintained in the non-deployed position by abutment with the inner walls of pressure vessel 14. Alternatively, UAV 12 may be prepackaged in a launch tube, which is inserted into main storage cavity 20 and which maintains the collapsible wings in the non-deployed state until UAV launch. The dimensions of storage cavity 20 and, more generally, the dimensions of pressure vessel 14 can be scaled, as appropriate, to accommodate Unmanned Aerial Vehicles of various sizes. The geometry of pressure vessel 14 may also be varied, as desired; however, it is preferred that pressure vessel 14 is generally tubular in shape to optimize the structural integrity of pressure vessel 14 and to facilitate transport and storage of STAL canister 10 using, for example, universal boat rack systems.

Figure 2:
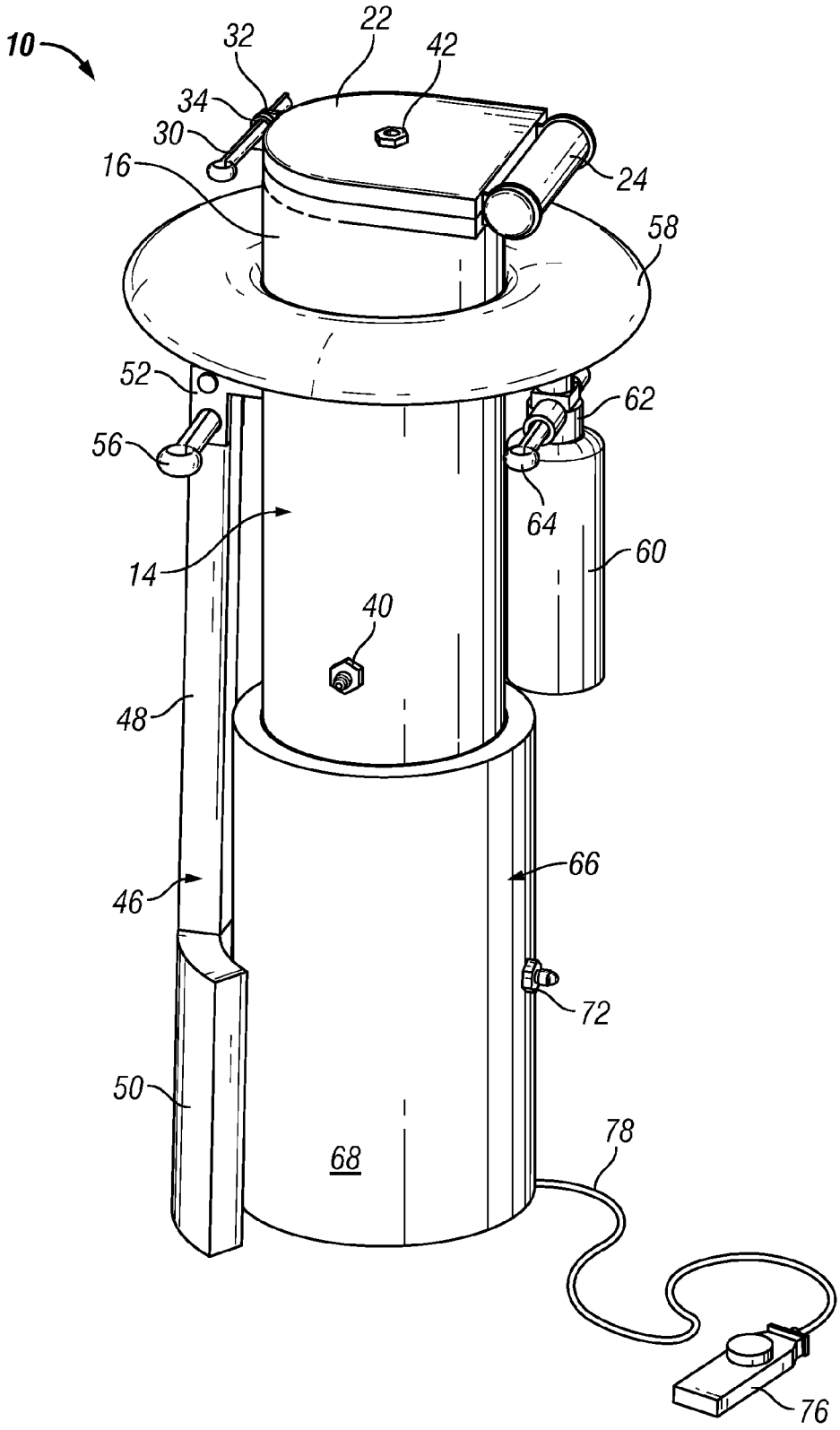
FIGS. 2 and 3 are isometric views of the STAL canister shown in FIG. 1 in a watertight transport state and in a launch-ready state, respectively.
Figure 3:
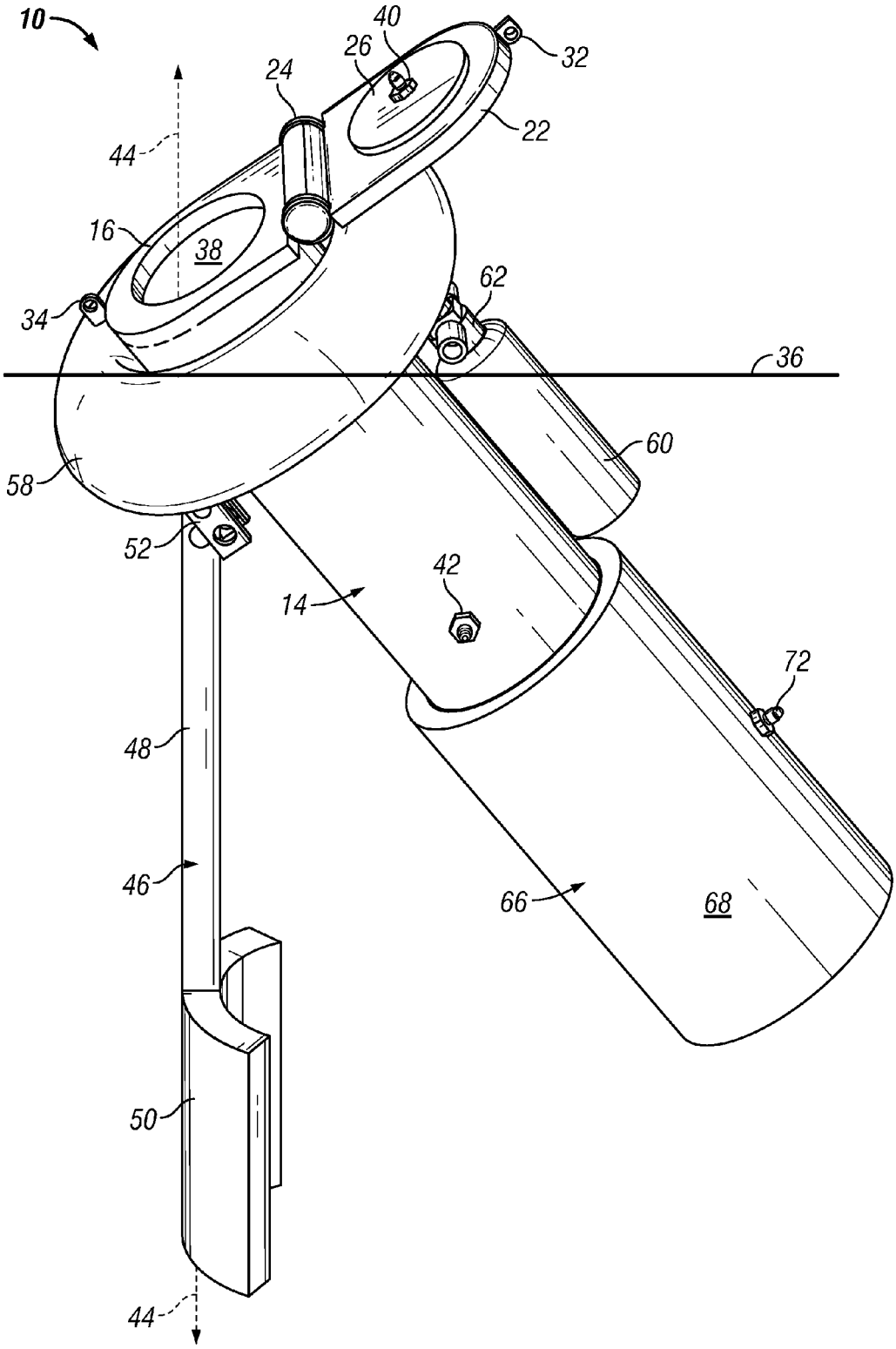

FIGS. 2 and 3 are isometric views illustrating STAL canister 10 in a watertight transport state and in a launch-ready state, respectively. Referring collectively to FIGS. 1-3, STAL canister 10 further includes a diver-actuated cap 22 and a hinge member 24, which hingedly couples diver-actuated cap 22 to open end portion 16 of pressure vessel 14. Diver-actuated cap 22 is rotatable between a closed position (FIGS. 1 and 2) and an open position (FIG. 3). In the closed position (FIGS. 1 and 2), diver-actuated cap 22 sealingly engages open end portion 16 to prevent the ingress of water into storage cavity 20 and the wetting of UAV 12 during underwater transport of STAL canister 10. To improve the sealing characteristics of diver-actuated cap 22 in the closed position (FIGS. 1 and 2), one or more seals may be disposed between diver-actuated cap 22 and open end portion 16 of pressure vessel 14. For example, as generically illustrated in FIG. 1, an O-ring 27 may be disposed around a cylindrical protrusion 26 provided on the underside of diver-actuated cap 22. When diver-actuated cap 22 is in the closed position (FIGS. 1 and 2), O-ring 27 (FIG. 1) is sealingly compressed between the outer circumferential wall of cylindrical protrusion 26 (FIGS. 1 and 3) and an inner circumferential wall of open end portion 16 to provide a watertight seal to a depth of, for example, several hundred meters.

Diver-actuated cap 22 is conveniently, although not necessarily, biased toward the open position shown in FIG. 3 by one or more resilient elements. For example, as indicated in FIG. 1, a compression spring 28 may be compressed between diver-actuated cap 22 and open end portion 16 when diver-actuated cap 22 is in the closed position (FIGS. 1 and 2) to resiliently urge diver-actuated cap 22 toward the open position shown in FIG. 3. Alternatively, and as a second example, diver-actuated cap 22 may be biased toward the open position (FIG. 3) by a torsion spring included within hinge member 24.

In embodiments wherein diver-actuated cap 22 is biased toward the open position (FIG. 3), STAL canister 10 is further equipped with a manual cap actuation mechanism, which physically prevents cap 22 from rotating into the open position until the desired time of deployment. Although the manual cap actuation mechanism may assume any form suitable for maintaining diver-actuated cap 22 in the closed position (FIGS. 1 and 2), it is generally desirable for the manual cap actuation mechanism to comprise a relatively simple and non-electrical structural member to ensure reliability in harsh operating environments. It is also desirable for the manual cap actuation mechanism to be relatively easy to activate for a diver operating in adverse maritime conditions (e.g., low ambient light, Sea States approaching or exceeding Code 3, etc.) and likely wearing diver's gloves, a diver's mask, and other scuba gear. In the illustrated exemplary embodiment, and as shown most clearly in FIG. 2, the manual cap actuation mechanism assumes the form of a pull pin 30. When diver-actuated cap 22 is in the closed position (FIGS. 1 and 2), pull pin 30 extends through an eyelet provided on a first tab 32 projecting from diver-actuated cap 22 and through an aligning eyelet provided on a second tab 34 projecting from open end portion 16. When positioned in this manner, pull pin 30 (FIG. 2) physically retains tab 32 adjacent tab 34 to thereby maintain diver-actuated cap 22 in the closed position (FIGS. 1 and 2). When pull pin 30 is removed, tab 32 is free to move with respect to tab 34, and diver-actuated cap 22 rotates under the influence of compression spring 28 (FIG. 1) into the open position shown in FIG. 3. Pull pin 30 thus provides a simple and reliable manner by which a diver can initiate the rotation of diver-actuated cap 22 into the open position (FIG. 3) prior to launch of UAV 12.

As described more fully below in conjunction with FIG. 4, a diver ensures that open end portion 16 of pressure vessel 14 is appropriately positioned above the water's surface (represented in FIG. 3 by water line 36) before removing pull pin 30 and allowing diver-actuated cap 22 to rotate into the open position. However, even when the port of open end portion 16 is positioned above water line 36, surface wave activity can still potentially cause water to splash into open end portion 16 and wet UAV 12. Therefore, to protect UAV 12 (FIG. 1) from splash damage when diver-actuated cap 22 is in the open position (FIG. 3), STAL canister 10 may further be equipped with a waterproof membrane 38 (shown in FIGS. 1 and 3). As may be most easily appreciated in FIG. 1, waterproof membrane 38 is installed within open end portion 16 between UAV 12 and diver-actuated cap 22. Waterproof membrane 38 is preferably formed from a durable material that is substantially impermeable to water and consequently deters the ingress of water into storage cavity 20 during operation of STAL canister 10. At the same time, waterproof membrane 38 is preferably designed to enable UAV 12 to be launched therethrough; e.g., membrane 38 may be designed to breakaway or otherwise dislodged from pressure vessel 14 during launch of UAV 12. Materials from which waterproof membrane 38 may be formed include various types of high strength, polymeric sheets including, for example, Mylar® films.

STAL canister 10 further includes a vacuum port 40 and a pressure relief valve 42. Vacuum port 40 and pressure relief valve 42 are each fluidly coupled to main storage cavity 20 of pressure vessel 14. In the exemplary embodiment illustrated in FIGS. 1-3, specifically, pressure relief valve 42 is mounted through a central portion of diver-actuated cap 22, and vacuum port 40 is mounted through the annular wall of pressure vessel 14. Vacuum port 40 enables the sealing characteristics of STAL canister 10 to be tested when diver-actuated cap 22 is in the closed position (FIGS. 1 and 2) without submersion of canister 10. By comparison, pressure relief valve 42 vents gas flow from storage cavity 20 to the exterior of STAL canister 10 if the pressure within storage cavity 20 should surpass a predetermined upper threshold due to, for example, combustion of an electrical or chemical component (e.g., a lithium ion battery) included within UAV 12. In so doing, pressure relief valve 42 prevents the pressure within storage cavity 20 from accumulating to undesirably high levels and, thus, helps render STAL canister 10 handsafe. In one embodiment, vacuum port 40 and pressure relief valve 42 each assume the form of a spring-loaded poppet valve.

It has been found that the likelihood of successful transition of UAV 12 from the non-deployed position (FIG. 1) to flight can be maximized if, during launch, STAL canister 10 is tilted with respect to vertical; i.e., an imaginary axis substantially orthogonal to the water's surface, as represented in FIG. 3 by dashed line 44. The controlled tilting of STAL canister 10 also enables canister 10 to be positioned by a diver to prevent UAV 12 from being launched into an oncoming wave and/or to ensure that UAV 12 is launched into the wind to further facilitate transition to flight. It is therefore desirable to provide STAL canister 10 with a pressure vessel tilt system that, when activated, automatically tilts STAL canister 10 to a desired angular position. For example, the pressure vessel tilt system may assume the form of a weighted lever arm assembly, such as weighted lever arm assembly 46 described below.

With continued reference to the exemplary embodiment illustrated in FIGS. 1-3, weighted lever arm assembly 46 includes a lever arm 48 and a drogue weight 50. The upper end of lever arm 48 is pivotally coupled to pressure vessel 14 via a hinge member 52, and the lower end of lever arm 50 is fixedly attached to drogue weight 50. Weighted lever arm assembly 46 is rotatable relative to pressure vessel 14 between: (i) a non-deployed or transport position (shown in FIGS. 1 and 2) wherein the lower end of lever arm 48 and drogue weight 50 reside adjacent the body of pressure vessel 14, and (ii) a deployed or launch position (shown in FIG. 3) wherein the lower end of lever arm 48 and drogue weight 50 are angularly displaced from pressure vessel 14. Weighted lever arm assembly 46 is biased toward the deployed position by a compression spring 54 (shown in FIG. 1), which is compressed between lever arm 48 and an outer surface of pressure vessel 14 when weighted lever arm assembly 46 is in the non-deployed position. A manual lever arm deploy mechanism engages weighted lever arm assembly 46 in the non-deployed position to prevent rotation of assembly 46 into the deployed position (FIG. 3) until the desired time of deployment. As indicated in FIG. 2, the manual lever arm deploy mechanism may assume the form of a pull pin 56, which extends through an opening in hinge member 52 and an aligning in lever arm 48 to retain weighted lever arm assembly 46 in the non-deployed position (FIG. 2). Upon removal of pull pin 56, lever arm 48 rotates under influence of compression spring 54 (FIG. 1) into the deployed position shown in FIG. 3.

When released into the deployed position (FIG. 3), weighted lever arm assembly 46 remains generally fixed in three dimensional space, while pressure vessel 14 rotates with respect to vertical (again, represented in FIG. 3 by dashed line 44) due to the inherent buoyancy of the lower end portion 18. Release of weighted lever arm assembly 46 into the deployed position (FIG. 3) thus results in the controlled titling of pressure vessel 14 relative to vertical. Pressure vessel 14 may be prevented from rotating beyond the predetermined angular position by, for example, a tether or a hard stop feature (not shown) that engages lever arm 48 after a prescribed arc of travel. In one embodiment, the angular displacement between the longitudinal axes of pressure vessel 14 and lever arm 48 is between approximately 25° and approximately 50°, and preferably between approximately 35° and approximately 40°, when weighted lever arm assembly 46 rotates into the deployed position shown in FIG. 3. It should thus be appreciated that weighted lever arm assembly 46 serves as a pressure vessel tilt system that, upon diver removal of pull pin 56, causes pressure vessel 14 to rotate into a predetermined angular position to promote the successful transition of UAV 12 to flight and to provide the other benefits described above. In addition, drogue weight 50 helps stabilize pressure vessel 14 in the presence of waves.

To facilitate transport (e.g., carrying or towing) by a diver, STAL canister 10 preferably has a neutral or close-to-neutrally buoyancy when in the watertight transport state shown in FIGS. 1 and 2. However, in the launch-ready state shown in FIG. 3, STAL canister 10 preferably has a buoyancy that is sufficiently positive to maintain open end portion 16 of pressure vessel 14 above water line 36 during UAV launch. To satisfy these divergent criteria, STAL canister 10 is preferably further equipped with a variable-buoyancy floatation device, which is mounted to open end portion 16 of pressure vessel 14. In the exemplary embodiment illustrated in FIGS. 1-3, the variable-buoyancy floatation device assumes the form of an inflatable float collar 58, which is disposed around open end portion 16. As shown most clearly in FIG. 2, in the watertight transport state (FIGS. 1 and 2), float collar 58 is maintained in a deflated state to impart STAL canister 10 with a neutral or close-to-neutral buoyancy. By comparison, in the launch-ready state shown in FIG. 3, float collar 58 is inflated to impart STAL canister 10 with a positive buoyancy.

Inflation of float collar 58 is conveniently effectuated via application of a gas or gas mixture. For example, in certain embodiments, float collar 58 may include an external fill port (not shown) that enables a diver to inflate float collar 58 utilizing a spare oxygen tank carried by the diver or by an intermediary vehicle (e.g., a SEAL Delivery Vehicle). Alternatively, and as shown in FIGS. 1-3, a pressurized cartridge 60 (FIGS. 2 and 3) may be fluidly coupled to inflatable float collar 58 by way of a manually-actuated flow control valve 62 (FIGS. 2 and 3). Manually-actuated flow control valve 62 prevents the flow of gas or gas mixture (e.g., carbon dioxide) from cartridge 60 into float collar 58 until valve 62 has been actuated. In the illustrated example, a diver actuates flow control valve 62 by removing a pull pin 64 associated with valve 62. As may be appreciated by comparing FIG. 2 to FIG. 3, diver removal of pull pin 64 results in the opening of flow control valve 62 (and, more specifically, the movement of a valve element within valve 62) to enable gas flow from pressurized cartridge 60 into float collar 58 and the consequent inflation of float collar 58. As noted above, inflation of float collar 58 imparts STAL canister 10 with a positive buoyancy. Thus, after inflation of float collar 58, the diver need only release STAL canister 10 to allow canister 10 to rise to the water's surface. The diver may then carry out the remainder of the UAV launch sequence, as described more fully below in conjunction with STEP 94 and STEP 96 of FIG. 4. The foregoing notwithstanding, STAL canister 10 may be equipped with other types of flotation devices in alternative embodiments including various types of fixed-density floatation devices, such as foam flotation collars.

With continued reference to the exemplary embodiment illustrated in FIGS. 1-3, STAL canister 10 further includes a propellant device 66, which is configured to propel UAV 12 from storage cavity 20 and through open end portion 16 when propellant device 66 is actuated by a diver. Propellant device 66 may comprise any device, structural element, or assemblage of structural elements suitable for propelling UAV 12 (or other airborne object) from storage cavity 20 with a sufficient ejection velocity to enable UAV 12 to take flight. For example, in certain embodiments, propellant device 66 may assume the form of an explosive Cartridge Actuated Device (commonly referred to by the acronym "CAD") or a pre-filled pressurized gas reservoir. This notwithstanding, propellant device 66 preferably comprises a pressurized gas reservoir that can be filled by a diver with a pressurized gas or gas mixture immediately prior to launch of UAV 12. Further emphasizing this point, FIG. 1 generically illustrates propellant device 66 as including a pressurized gas reservoir 68, which is fluidly coupled to main storage cavity 20 by a flow control valve 70. As shown most clearly in FIGS. 2 and 3, pressurized gas reservoir 68 may have a substantially annular geometry and may be disposed around lower end portion 18 of pressure vessel 14. A fill port 72 is fluidly coupled to pressurized gas reservoir 68 and is manually accessible from the exterior of STAL canister 10. Fill port 72 enables a diver to fill pressurized gas reservoir 68 with a gas or gas mixture (e.g., oxygen) prior to performance of the launch sequence described below in conjunction with FIG. 4. By enabling propellant device 66, and specifically pressurized gas reservoir 68, to be filled immediately prior to launch, STAL canister 10 can remain "de-energized" during primary transport and thereby help render STAL canister 10 handsafe.

As further illustrated in FIG. 1, a diver launch control 76 is operatively coupled to an actuator 74, which is, in turn, operatively coupled to flow control valve 70. Diver launch control 76 includes a button or other manual input that can be actuated by a diver to initiate launch of UAV 12. Actuator 74 may comprise any mechanical or electro-mechanical device suitable for moving flow control valve 70 into an open position to allow pressurized gas flow from pressurized gas reservoir 68 into main storage cavity 20 upon diver actuation. In one embodiment, actuator 74 assumes the form of a solenoid. As illustrated in FIGS. 1 and 2, diver launch control 76 is conveniently coupled to actuator 74 by way of an elongated tether 78, which has a length sufficient to enable a diver to swim a predetermined distance away from pressure vessel 14 prior to initiating launch of UAV 12. In such a case, diver launch control 76 may also be referred to as a "diver's pendant" and is conveniently stored on STAL canister 10 when not in use. In further embodiments, diver launch control 76 may be mounted directly to another component of STAL 10, such as actuator 74 or propellant device 66; and, in still further embodiments, diver launch control 76 may comprise a wireless transmitter capable of sending a launch signal to a wireless receiver (not shown) operably coupled to actuator 74.

Figure 4:
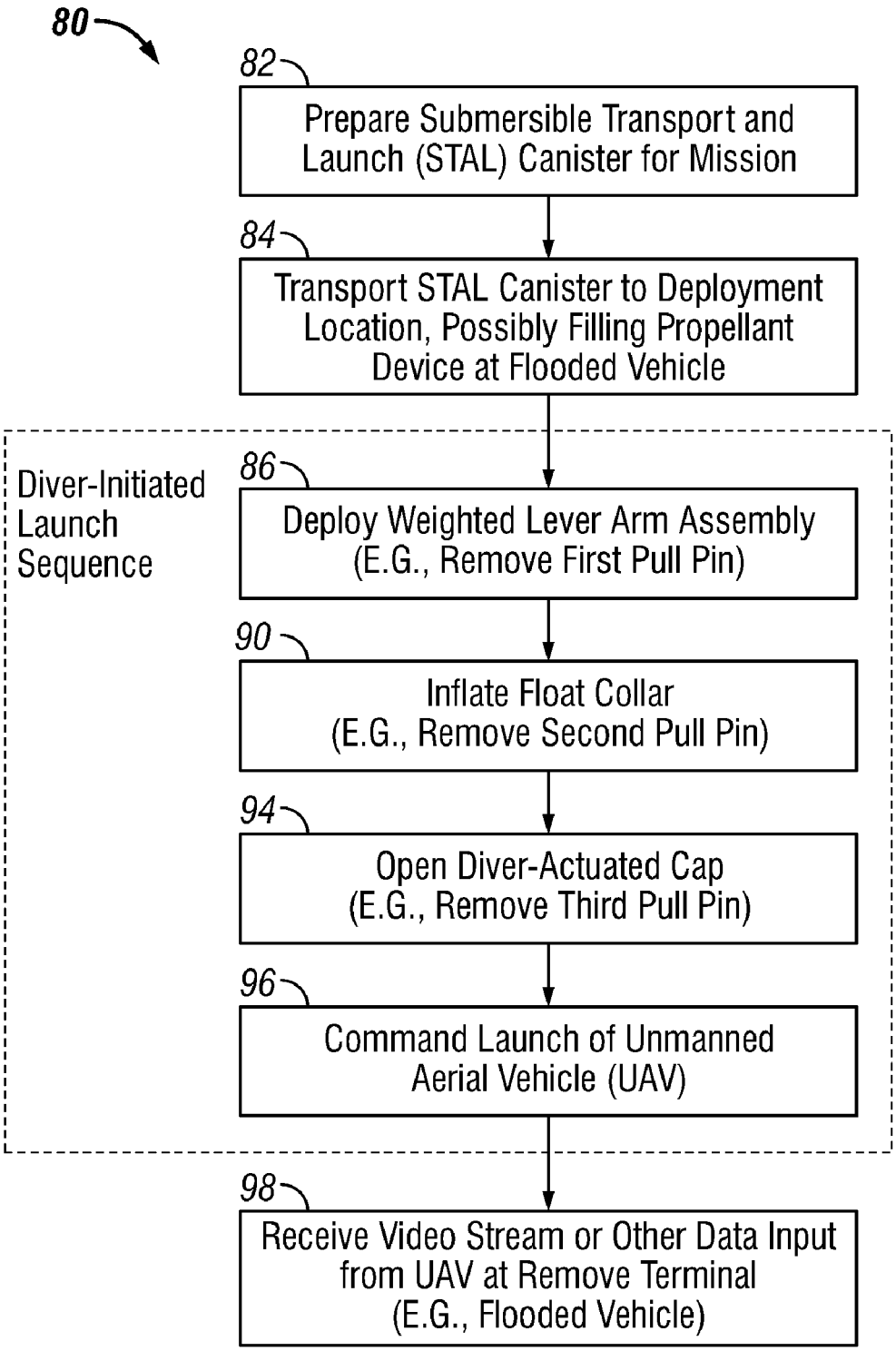
FIG. 4 is a flowchart illustrating an exemplary method that can be performed by a diver to carry out the sea-to-air deployment an Unmanned Aerial Vehicle utilizing a STAL canister, such as the STAL canister shown in FIGS. 1-3.

FIG. 4 is a flowchart illustrating an exemplary method 80 that may be performed by a diver to carry out the sea-to-air deployment an Unmanned Aerial Vehicle, such as UAV 12 shown in FIG. 1. For ease of explanation, exemplary method 80 will be described in conjunction with the above-described exemplary embodiment of STAL canister 10 as illustrated in FIGS. 1-3 and as further illustrated in FIGS. 5 and 6. It is, however, emphasized that exemplary method 80 may be carried out utilizing embodiments other than the illustrated exemplary embodiment of the Submersible Transport and Launch Canister, which may vary in structural features and functionalities. Similarly, exemplary method 80 is presented by way of example only, and further embodiments of method 80 may include additional steps, may omit certain steps, or may perform steps in an order different than that shown in FIG. 4 and described herein below.

To commence method 80 (STEP 82, FIG. 4), STAL canister 10 is prepared for subsequent diver usage. During preparation of STAL canister 10, an airborne object, such as UAV 12 (FIG. 1), is loaded into main storage cavity 20 (FIG. 1) of pressure vessel 14. Furthermore, in many embodiment, waterproof membrane 38 will then be installed within open end portion 16 over UAV 12 as described above. Diver-actuated cap 22 is then moved into the closed position and secured therein utilizing the manual cap actuation mechanism; e.g., via insertion of pull pin 30 through the aligning eyelets provided in tabs 32 and 34 (FIG. 2). Finally, with diver-actuated cap 22 in a closed position (FIGS. 1 and 2), a vacuum testing apparatus may be connected to vacuum test port 40 to partially evacuate gas from storage cavity 20 and thereby test the sealing characteristics pressure vessel 14 prior to actual submersion thereof.

Next, during STEP 84 (FIG. 4), STAL canister 10 is transported to the designated location of deployment. The transportation of STAL canister 10 may be performed in several sequential steps utilizing one or more vehicles. First, a submarine or surface boat may transport STAL canister 10 and at least one diver to a waypoint nearby the designated location of deployment. STAL canister 10 may then be loaded onto an intermediary vehicle, such as a second surface boat or a diver-operated flooded vehicle (e.g., a SEAL delivery vehicle). The diver may then navigate the intermediary vehicle toward the designated location of deployment, halt the intermediary vehicle prior to reaching the designated location of deployment, unload STAL canister 10 from the intermediary vehicle, and swim STAL canister 10 to the designated location of the deployment. Notably, manual underwater transport of STAL canister 10 is facilitated in embodiments wherein STAL canister 10 is neutrally or close-to-neutrally buoyant in the watertight transport state (FIGS. 1 and 2). After reaching the location of deployment, the diver may then carry out the UAV launch sequence described below in conjunction with STEPS 86, 88, 94, and 96 below. In embodiments wherein propellant device 66 comprises a pressurized gas reservoir (e.g., gas reservoir 68 shown in FIG. 1) intended to be filled immediately prior to UAV launch, a diver may fill the pressurized gas reservoir with a gas or gas mixture before swimming to the deployment location utilizing, for example, an oxygen tank carried by the intermediary vehicle. In certain embodiments, the diver may fill gas reservoir 68 to a predetermined pressure sufficient to ensure that UAV launch occurs at a minimum ejection velocity, which may be determined based upon the physical characteristics of UAV 12 (e.g., the dimensions, weight, and wingspan of UAV 12) and which will commonly be at least twice the stall speed of UAV 12.

Figure 5:
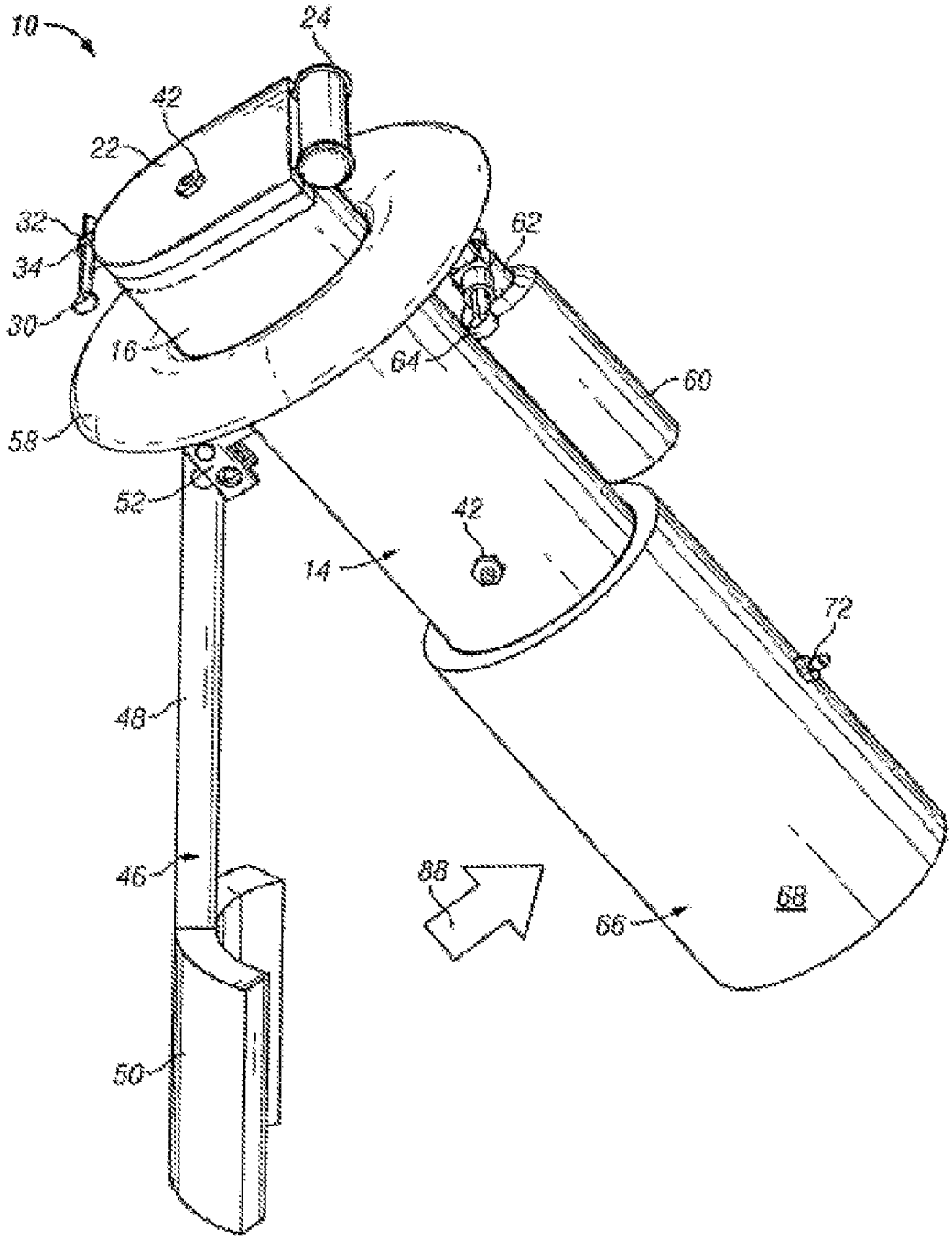
FIGS. 5 and 6 are isometric views of the STAL canister shown in FIGS. 1-3 during intermediate stages of a diver-initiated launch sequence performed in accordance with the method illustrated in FIG. 4.
Figure 6:
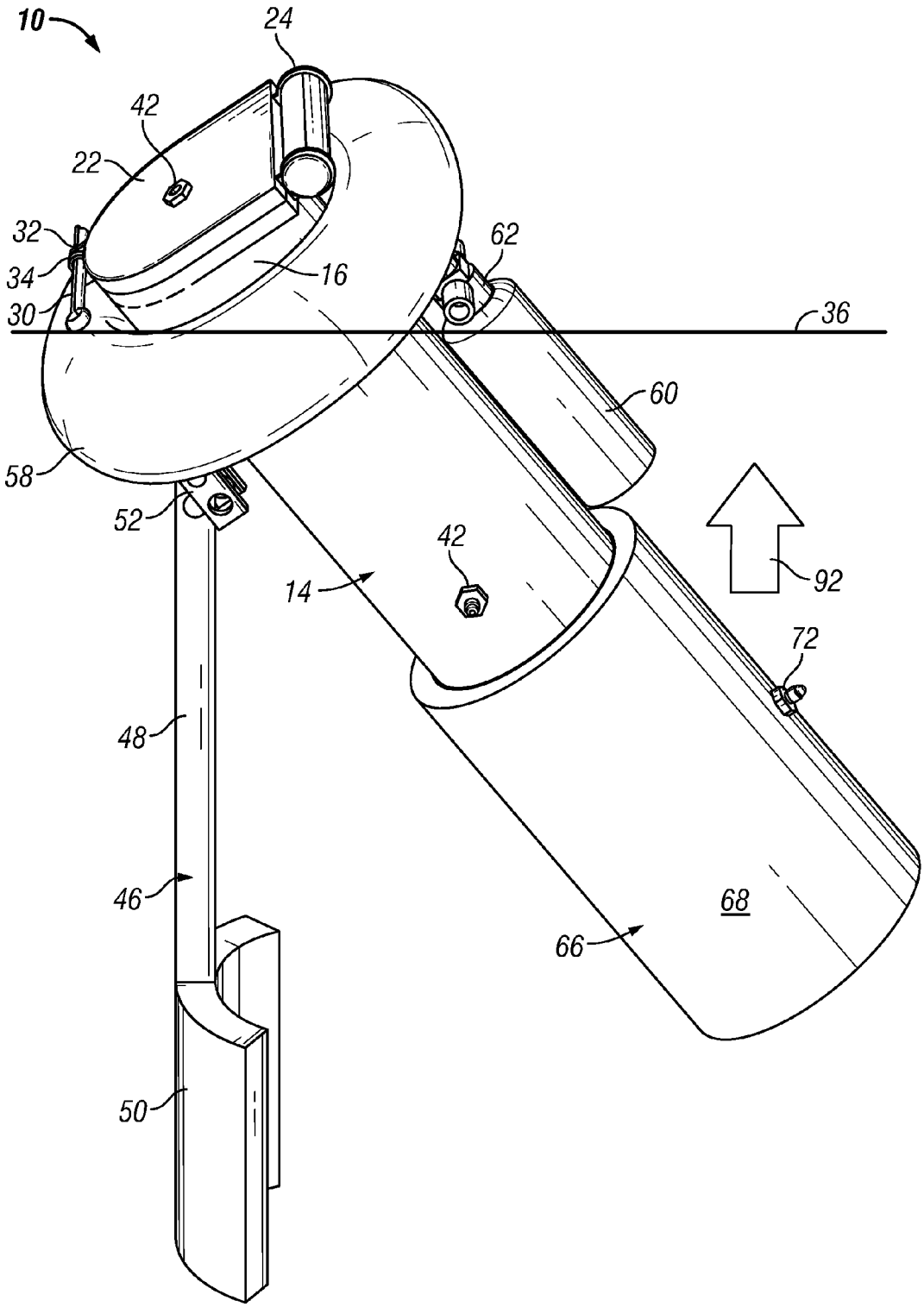

After swimming STAL canister 10 to the designated location of deployment (STEP 84, FIG. 4), the diver next performs a series of steps to effectuate launch of UAV 12 (FIG. 1). First, at STEP 86 (FIG. 4), the diver deploys weighted lever arm assembly 46 by, for example, removing pull pin 56 (FIG. 2). As indicated in FIG. 5 by arrow 88, removal of pull pin 56 releases lever arm 48 into the deployed position and allows pressure vessel 14 to rotate about the hinge line axis of hinge member 52 into the predetermined tilted launch position. Second, at STEP 90 (FIG. 4), the diver inflates float collar 58 by, for example, removing pull pin 64. As previously explained, inflation of float collar 58 provides a positive buoyancy to STAL canister 10 (indicated in FIG. 6 by arrow 92). Thus, after inflation of float collar 58, the diver need only release STAL canister 10 to allow canister 10 to rise to the water's surface such that open end portion 16 and diver-actuated cap 22 are positioned above the water's surface. The diver next removes pull pin 30, and diver-actuated cap 22 rotates into the open position under the influence of compression spring 28 (FIG. 1). FIG. 3 illustrates STAL canister 10 at this juncture in method 80. Finally, at STEP 96 (FIG. 4), the diver commands launch of UAV 12 utilizing diver launch control 76. In particular, a diver may command launch of UAV 12 by removing diver launch control 76, swimming a set distance away from STAL canister 10, and depressing the input button provided on diver launch control 76. In response to the actuation of diver launch control 76, actuator 74 moves flow control valve 70 into an open position; pressurized gas flow from pressurized gas reservoir 68, through flow control valve 70, and into main storage cavity 20; and UAV 12 is ejected from storage cavity 20, through waterproof membrane 38 (when provided), and through open end portion 16 of pressure vessel 16. In this manner, a diver utilizes STAL canister 10 to initiate launch of UAV 12 (or other airborn object) from pressure vessel 14 while in the body if water.

To complete exemplary method 80 (STEP 98, FIG. 4), data input is received from UAV 12 (FIG. 1) now inflight. For example, in embodiments wherein UAV 12 is equipped with one or more cameras or similar devices (e.g., a daytime camera, a nighttime camera, a synthetic aperture radar, etc.), UAV 12 may provide real-time streaming video, which may be received by the diver using equipment deployed aboard the intermediary vehicle (e.g., the SEAL delivery vehicle. Video and other such sensor data provided by UAV 12 may also be received by a submarine or surface boat, by a ground crew near the designated deployment area, and/or by a remotely-located ground control station. In this manner, UAV 12 may provide covert aerial surveillance, intelligence, and reconnaissance of designated littoral area in support of a nearby on-the-ground troop presence.

The foregoing has thus provided an exemplary embodiments of a Submersible Transport and Launch canister that can be utilized by a diver to transport and manually-initiate deployment of an Unmanned Aerial Vehicle or other airborne object. Notably, the above-described exemplary STAL canister is reliable, cost-effective, scalable, handsafe, and capable of preventing wetting of the Unmanned Aerial Vehicle during underwater transport and during the launch process. In addition, the above-described exemplary STAL canister enables the launch sequence to be covertly performed by a submerged diver operating under potentially adverse maritime conditions. As a still further advantage, the above-described exemplary STAL canister includes means (e.g., a weighted lever arm assembly) to ensure that the launch process is performed at a predetermined launch angle to promote successful transition of the UAV to flight.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A submersible transport and launch canister for use by a diver in the deployment of an airborne object, the submersible transport and launch canister comprising:

a pressure vessel having an open end portion and a storage cavity configured to receive the airborne object therein;

a weighted lever arm assembly movably coupled to the pressure vessel;

a diver-actuated cap movable between an open position and a closed position in which the diver-actuated cap sealingly engages the open end portion; and a propellant device fluidly coupled to the storage cavity and configured to propel the airborne object from the storage cavity and through the open end portion when the propellant device is actuated;

wherein the weighted lever arm assembly is movable relative to the pressure vessel to tilt the pressure vessel.

2. A submersible transport and launch canister according to claim 1 wherein the propellant device comprises a pressurized gas reservoir fluidly coupled to the storage cavity.

3. A submersible transport and launch canister according to claim 2 wherein the propellant device further comprises a fill port fluidly coupled to the pressurized gas reservoir and manually accessible from the exterior of the submersible transport and launch canister.

4. A submersible transport and launch canister according to claim 2 further comprising:

a flow control valve fluidly coupled between the pressurized gas reservoir and the storage cavity, the flow control valve normally residing in a closed position wherein the flow control valve substantially prevents pressurized gas flow from the pressurized gas reservoir to the storage cavity;

an actuator operably coupled to the flow control valve; and a diver launch control operably coupled to the actuator and, when actuated, configured to cause the actuator to move the flow control valve into an open position.

5. A submersible transport and launch canister according to claim 4 further comprising an elongated tether operably coupling the diver launch control to the actuator.

6. A submersible transport and launch canister according to claim 1 wherein the diver-actuated cap is biased toward the open position, and wherein the submersible transport and launch canister further comprises a manual cap actuation mechanism engaging the diver-actuated cap in the closed position.

7. A submersible transport and launch canister according to claim 6 wherein the manual cap actuation mechanism comprises a pull pin.

8. A submersible transport and launch canister according to claim 1 further comprising a vacuum port fluidly coupled to the storage cavity.

9. A submersible transport and launch canister according to claim 1 further comprising a pressure relief valve fluidly coupled to the storage cavity and configured to vent gas from the storage cavity when the pressure therein surpasses a predetermined threshold.

10. A submersible transport and launch canister according to claim 1 wherein the weighted lever arm assembly comprises:

a drogue weight; and a lever arm having a first end portion hingedly coupled to the pressure vessel and having a second end portion fixedly coupled to the drogue weight.

11. A submersible transport and launch canister according to claim 10 wherein the weighted lever arm assembly is movable between a deployed position and a non-deployed position, wherein the drogue weight resides substantially adjacent the pressure vessel in the non-deployed position, and wherein the drogue weight is angularly displaced from the pressure vessel in the deployed position.

12. A submersible transport and launch canister according to claim 11 wherein the weighted lever arm assembly is biased toward the deployed position, and wherein the submersible transport and launch canister further comprises a manual lever arm deploy mechanism engaging the weighted lever arm assembly in the non-deployed position.

13. A submersible transport and launch canister according to claim 12 wherein the manual lever arm deploy mechanism comprises a pull pin.

14. A submersible transport and launch canister according to claim 1 further comprising a variable-density flotation device coupled to the pressure vessel.

15. A submersible transport and launch canister according to claim 14 where the variable-density flotation device comprises an inflatable float collar mounted around the open end portion of the pressure vessel.

16. A submersible transport and launch canister according to claim 1 further comprising a waterproof membrane installed within the storage cavity over the airborne object.

17. A submersible transport and launch canister, comprising:

a pressure vessel having an open end portion and a storage cavity;

a weighted lever arm assembly movably coupled to the pressure vessel; an airborne object stored within the storage cavity;

a diver-actuated cap movable between an open position and a closed position in which the diver-actuated cap sealingly engages the open end portion to impede the ingress of water into the storage cavity when the submersible transport and launch canister is submerged; and a propellant device fluidly coupled to the storage cavity and, upon diver actuation, configured to propel the airborne object from the storage cavity and through the open end portion;

wherein the weighted lever arm assembly is movable relative to the pressure vessel to tilt the pressure vessel.

18. A submersible transport and launch canister according to claim 17 wherein the airborne object comprises an Unmanned Aerial Vehicle stored in the storage cavity in a non-deployed state.

19. A submersible transport and launch canister for deployment of an airborne object, the submersible transport and launch canister comprising:

a pressure vessel having an open end portion and a storage cavity configured to receive the airborne object therein;

a cap movable between an open position and a closed position in which the cap sealingly engages the open end portion;

a float collar mounted to the pressure vessel proximate the open end portion;

a weighted lever arm assembly hingedly coupled to the pressure vessel, wherein the weighted lever arm assembly is movable relative to the pressure vessel to tilt the pressure vessel; and a propellant device coupled to the storage cavity and configured to launch the airborne object from the storage cavity and through the open end portion when the propellant device is actuated.

* * * * *